United States Patent [19]

Haynes et al.

[11] 4,250,773

[45] Feb. 17, 1981

[54] ROTARY TONG INCORPORATING INTERCHANGEABLE JAWS FOR DRILL PIPE AND CASING

[75] Inventors: Charles W. Haynes, Spring; Adrian E. Pitts, Houston, both of Tex.

[73] Assignee: Joy Manufacturing Company, Pittsburgh, Pa.

[21] Appl. No.: 32,812

[22] Filed: Apr. 24, 1979

[51] Int. Cl.[3] ..... B25B 17/00

[52] U.S. Cl. ..... 81/57.18; 81/57.2; 81/57.21

[58] Field of Search ..... 81/57.18, 57.20, 57.21

[56] References Cited

U.S. PATENT DOCUMENTS

| | | | |
|---|---|---|---|
| 2,879,680 | 3/1959 | Beeman et al. | 81/57.18 |
| 3,261,241 | 7/1966 | Catland | 81/57.18 |
| 3,371,562 | 3/1968 | Kelley | 81/57.18 |
| 3,625,095 | 12/1971 | Barnett et al. | 81/57.18 |

*Primary Examiner*—James L. Jones, Jr.
*Attorney, Agent, or Firm*—Thomas H. Murray

[57] ABSTRACT

A rotary tong used in well-drilling operations to make-up and break-out drill strings which incorporates readily-interchangeable sets of jaws, one of which may be used for drill pipe and the other of which can be used for relatively thin-walled well casing.

6 Claims, 5 Drawing Figures

10
12
18
18
20
22
24
26
28
30
32
34
38
40
42
46
46
50
50
52
54
56
58
60
62
64
66
66
68
68
68
68
II
II

ROTARY TONG INCORPORATING INTERCHANGEABLE JAWS FOR DRILL PIPE AND CASING

BACKGROUND OF THE INVENTION

In well-drilling operations, a rotor tong is used to grip and rotate lengths of pipe or rods which are connected together by threaded end sections. In the usual case, the tong is of the open-headed type, having a bifurcated frame with a central opening and an outwardly-open passageway which permits the tong to be positioned around a pipe joint without the necessity of lowering the tong over a length of the pipe.

When the tong is operated, pipe-gripping means are caused to revolve around the aforesaid central opening, these jaws causing the pipe or casing section to rotate. In the case of drill pipe or rod, the jaws are moved radially inwardly by a cam action to engage and clamp against the sides of the drill pipe which is relatively thick-walled. On the other hand, when a relatively thin-walled casing is being inserted into the well, the force exerted by radially-inwardly moving jaws will deform the tube wall. Accordingly, it has been common, when inserting casing into the well, to utilize jaws which rotate inwardly toward the casing about pivot points. Since the same type of clamping element cannot be used on both drill pipe and casing, it is desirable to provide interchangeable jaws on the same tong. In the past, however, so-called interchangeable tong systems required virtual complete disassembly and reassembly of the entire tong when changing from one type of jaw to the other.

SUMMARY OF THE INVENTION

In accordance with the present invention, a tong system is provided adapted to utilize either drill rod jaws or casing jaws which may be readily interchanged by removing and reinserting only a single bolt for each jaw.

In one embodiment of the invention, the tong assembly comprises an annular rotor carried within a housing and incorporating drive means carried by the housing for rotating the rotor. Rotatable with the rotor is a jaw assembly comprising upper and lower plate members on opposite sides of the housing and the annular rotor which it carries, together with removable bolt members interconnecting the plate members.

The jaw assembly also includes two sets of interchangeable jaw elements each of which has at least one bore through which an associated one of the aforesaid bolt members is adapted to pass to secure the jaw elements to the plate members. The jaw elements in the two sets are each provided with a cam follower adapted to engage an associated one of two diametrically-opposite cam surfaces on the inner periphery of the annular rotor. The jaw elements in one set are movable radially inwardly upon relative movement between the plate members and the annular rotor due to movement of the cam followers on associated ones of the aforesaid cam surfaces. Each of the jaw elements in the other set comprises an arm pivotally connected to its associated bolt member interconnecting the aforesaid plate members and is pivotal radially inwardly about the bolt member upon relative movement between the plate members and the annular rotor, again due to movement of the cam follower and an associated one of the cam surfaces. Relative movement between the plate members and the rotor, to permit movement of the cam followers on the diametrically-opposite cam surfaces, is facilitated by means of a friction brake which engages one or both of the two plate members.

In the preferred embodiment of the invention, radial slots are provided on the facing surfaces of the two plate members to receive the drill rod gripping jaws. These slots, however, are not used when the casing jaws are employed.

The above and other objects and features of the invention will become apparent from the following detailed description taken in connection with the accompanying drawings which form a part of this specification, and in which.

Figure 1:
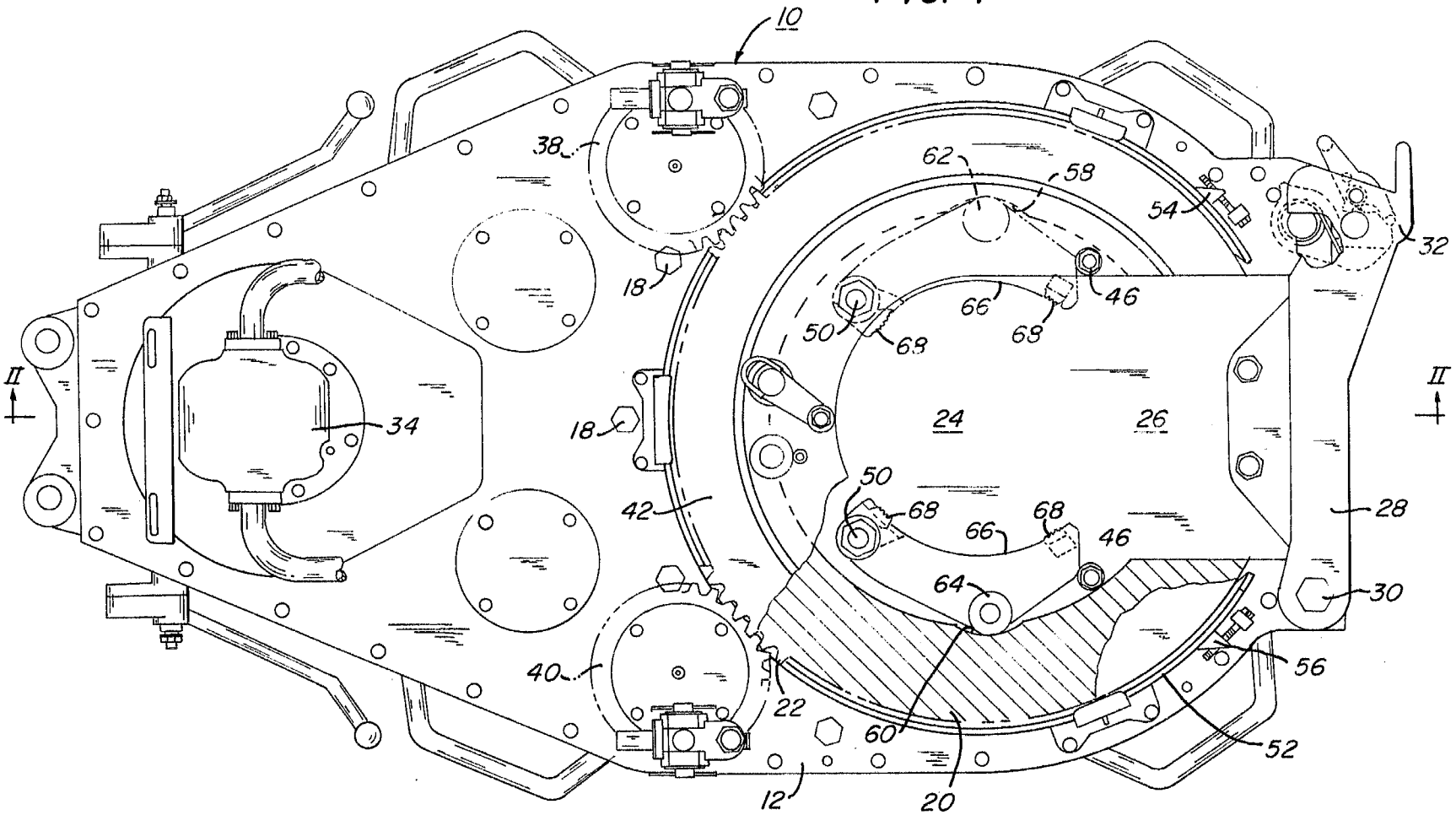
FIG. 1 is a top view of the tong assembly of the invention having incorporated therein pivoted casing jaws.
Figure 2:
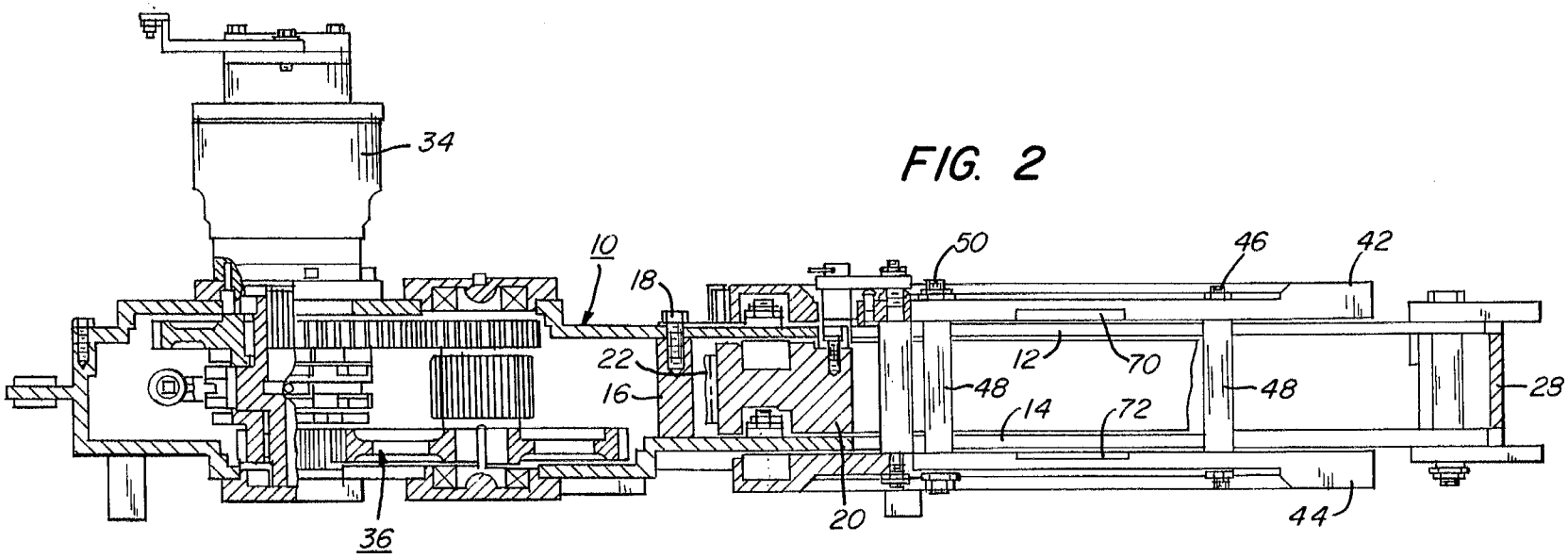
FIG. 2 is a vertical cross-sectional view of the arrangement shown in FIG. 1 taken substantially along line II—II of FIG. 1.

With reference now to the drawings, and particularly to FIGS. 1 and 2, the tong assembly shown includes a housing 10 comprising upper and lower plates 12 and 14 spaced apart by spacers 16 (FIG. 2) and held together by means of bolts 18 threaded into the spacers 16. The left end of the housing 10, as shown in FIG. 2, encloses gearing about to be described; while the right end carries a split ring or annular rotor 20 having gear teeth 22 formed on its outer periphery.

As is best shown in FIG. 1, the upper and lower plates 12 and 14 are provided with semicircular openings 24 which communicate with slotted portions 26 to permit the tong assembly to be inserted over a tube or pipe section which is to be rotated. At the end of the slotted sections 26 in the upper and lower plates 12 and 14 is a door assembly 28 pivotally connected to the housing 10 at 30 and provided at its other end with a releasable latch 32. In the use of the tong assembly, the latch 32 is disengaged; the door assembly 28 is pivoted outwardly; and the tong is then pushed into a position where the pipe or tubing to be rotated is within the semicircular portion 24, whereupon the gate assembly is again closed and latched.

Carried on the top of the housing 10 is a pneumatic motor 34 which, through suitable gearing generally identified by the reference numeral 36 in FIG. 2, rotates two pinion gears 38 and 40 (FIG. 1). The gears 38 and 40, in turn, mesh with the gear teeth 22 on the outer periphery of the rotor 20 such that as the gears 38 and 40 rotate, so also will the rotor 20, the spacing between the gears 38 and 40 insuring that the rotor will continue to rotate whenever the annular gap at the forward end of the rotor is out of engagement with one or the other of the gears 38 or 40.

Adjacent the upper and lower surfaces, respectively, of the housing plates 12 and 14 are annular plates 42 and 44. These are interconnected by bolts 46 which pass through spacers 48 as well as by bolts 50 which serve to hold the jaws of the tong assembly in place in a manner hereinafter described. Surrounding the periphery of the upper plate 42 is a drag band 52 which can be tightened against the periphery of the plate by means of adjusting screws 54 and 56 located at the forward end of the assembly.

As best shown in FIG. 1, the inner periphery of the rotor 20 is provided with diametrically-opposite depressions or cam surfaces 58 and 60 which receive cam followers 62 and 64 carried on pivoted jaw elements 66. The jaw elements 66 are those which are used to grip relatively thin-walled casing and are pivotally mounted to the upper and lower plates 40 and 42 by the bolts 50. Jaw inserts 68 are carried at opposite ends of the pivoted jaw elements 66 as shown.

In the operation of the assembly shown in FIGS. 1 and 2, the door assembly 28 is opened and the tong assembly is inserted over a casing which is to be rotated so as to thread it into an aligned casing section, for example. Thereafter, the door assembly 28 is closed and the pneumatic motor 34 is actuated to rotate the rotor 20 between the housing plates 12 and 14. As the rotor rotates, the upper and lower plates 42 and 44 initially will be held stationary by the drag band 52. During this time, the cam followers 62 and 64 ride up the cam surfaces 58 and 60 formed on the inner periphery of the rotor, thereby forcing the jaw elements 66 to rotate inwardly about the axes of bolts 50 until they engage the outer periphery of a casing section. At this point, and due to the frictional engagement between the casing section and the jaw elements, the upper and lower plates 42 and 44 will overcome the restraining force of the drag band 52 and will rotate with the rotor, thereby carrying the plates 42 and 44 and the jaw elements 66 mounted thereon with it. In this process, the casing section is, of course, caused to rotate. Due to the fact that the jaw elements 66 are pivoted about the axes of bolts 50, and because of the spacings between the cam followers 62 and 64 and the bolts 50, the radial force exerted on the tube wall by the jaw elements 66 is relatively light and will not deform the casing wall.

As was explained above, when it is desired to utilize the tong for heavy-walled drill pipe or drill rod, a much higher force or gripping action on the tube walls is desired, greater than that provided by the pivoted jaw elements shown in FIGS. 1 and 2. In the past, it was usually necessary to disassemble almost the entire tong assembly and then reassemble it in order to substitute drill-pipe type jaw elements for those shown in FIGS. 1 and 2.

Figure 4:
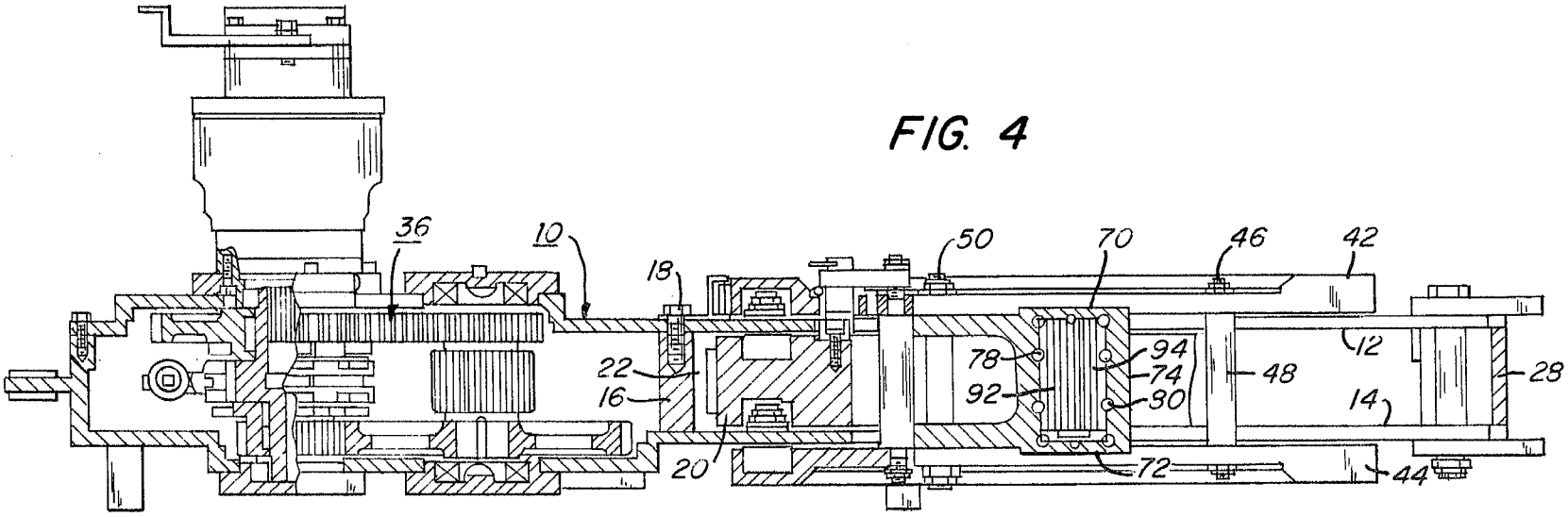
FIG. 4 is a cross-sectional view taken substantially along line IV—IV of FIG. 3.
Figure 3:
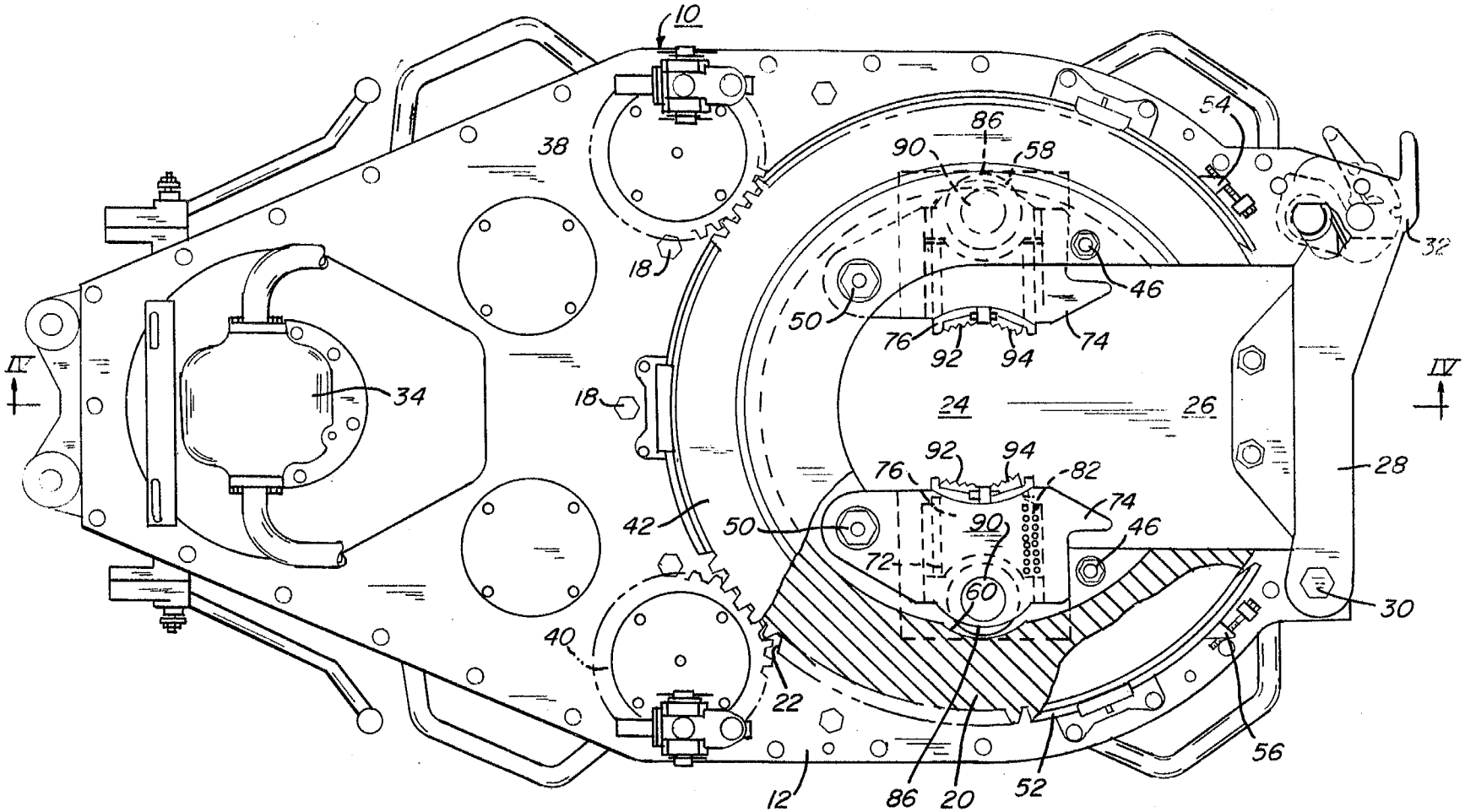
FIG. 3 is a top view, identical to that of FIG. 1 but showing the drill rod gripping jaws inserted into the tong assembly of the invention.

In accordance with the present invention, however, the pivoted jaw elements shown in FIGS. 1 and 2 may be easily replaced. This is achieved, among other things, by providing slots 70 and 72 (see FIGS. 2 and 4) on the facing surfaces of the plates 42 and 44 which are diametrically opposite each other in the area of the cam surfaces 58 and 60. These slots 70 and 72 receive a casing 74, perhaps best shown in FIG. 5, which, when inserted into the slots 70 and 72, is held in place by the same bolt 50 about which a jaw element 66 pivots. Fitted into the interior of the casing 74 is a reciprocable jaw element 76 (FIG. 5) provided with semicircular openings 78 which cooperate with semicircular slots 80 in the casing 74 to provide bores for the reception of coil springs 82. The radially outer end of the jaw element 76 is provided with slots 84 which receive cam followers 86 and 88, these being mounted for rotation on shaft 90. As shown in FIG. 3, the cam followers 86 and 88 engage the same cam surfaces 58 and 60 as did the cams 64 for the jaw elements shown in FIG. 1. The cam followers 86 and 88 are urged outwardly and into engagement with the cam surfaces 58 and 60 by means of the coil springs 82. When the rotor 20 is caused to rotate by the gears 38 and 40, initial rotation of the rotor will cause the cams 86 and 88 to ride up the cam surfaces 58 and 60, thereby causing the elements 76 to move radially inwardly directly against the side of the drill pipe until the restraining force of the drag band 52 is overcome, whereupon the jaw assemblies, the rotor 20 and the upper and lower plates 42 and 44 will all rotate to rotate the drill pipe itself. Pipe gripping elements 92 and 94 on each jaw element 76 are held in place by spring pins 96.

Figure 5:
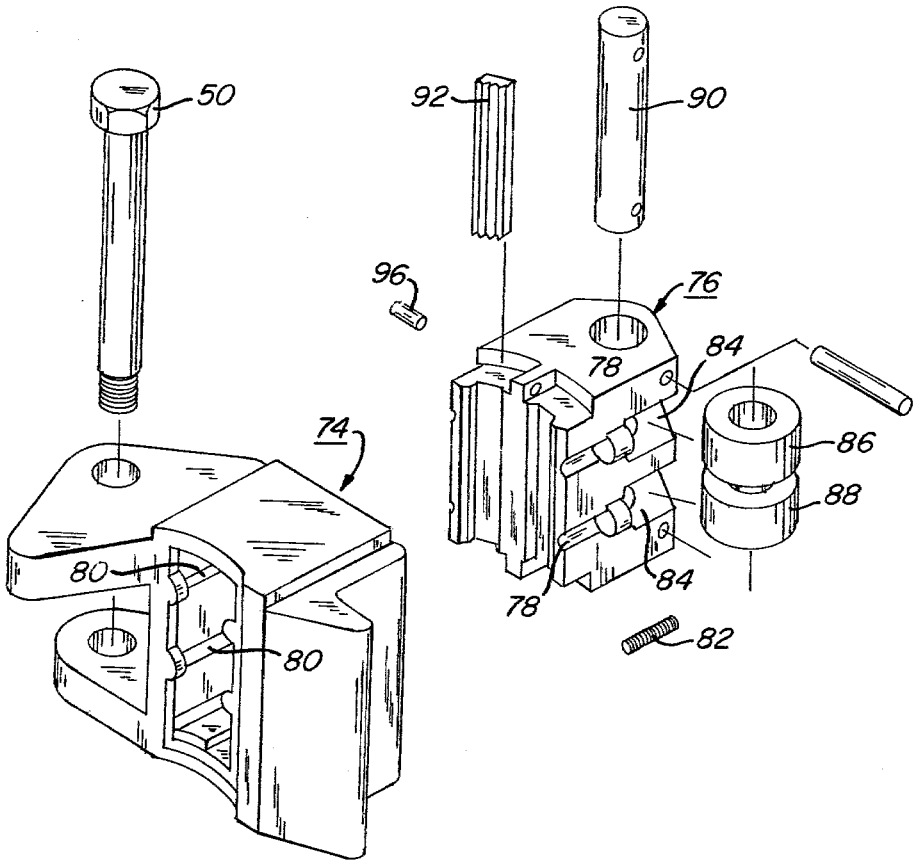
FIG. 5 is an exploded view of one of the two drill rod gripping jaws utilized in the arrangement shown in FIGS. 3 and 4.

In order to reinsert the casing jaw elements 66, it is necessary only to remove the bolts 50, slide the assemblies shown in FIG. 5 out of the guideways 70 and 72 and reinsert the jaw elements shown in FIG. 1.

Although the invention has been shown in connection with certain specific embodiments, it will be readily apparent to those skilled in the art that various changes in form and arrangement of parts may be made to suit requirements without departing from the spirit and scope of the invention.

We claim:

1. In a power tong, the combination of:

a housing;

a generally annular rotor carried by said housing and rotatable relative to said housing about an axis extending generally perpendicular to the opposite sides of said housing;

cam surfaces formed on diametrically-opposite sides of the inner periphery of said annular rotor;

drive means carried by said housing for rotating said rotor;

a jaw assembly comprising plate members on opposite sides of said housing and said annular rotor; movable bolt members interconnecting said plate members;

two sets of interchangeable jaw elements either of which can be used independently of the other as a cooperating pair of pipe-gripping elements on said jaw assembly, each jaw element in each set having at least one bore through which an associated one of said bolt members is adapted to pass to secure a respective set of the jaw elements to said plate members;

each jaw element in each set of interchangeable jaw elements having a cam follower adapted to engage an associated one of the cam surfaces of said annular rotor, the jaw elements on one set being movable radially inwardly along a straight-line path of travel upon relative movement of the plate members and said annular rotor due to movement of said cam followers on associated ones of said cam surfaces, and the jaw elements in the other set comprising arms pivotally connected to their associated bolt members and pivotal radially inwardly about said bolt members upon relative movement of the plate members and said annular rotor due to movement of said last-mentioned cam followers on associated ones of said cam surfaces; and friction means for restraining rotation of said plate members.

2. The power tong of claim 1 wherein the jaw elements in said one set each comprise a hollow casing, and a grip-carrying element reciprocable within said casing and having a cam follower on the end thereof opposite said grip.

3. The power tong of claim 2 including spring means for urging said grip-carrying element radially outwardly to move said cam follower into engagement with an associated cam surface.

4. The power tong of claim 1 including slots in the facing surfaces of said plate members, and housings fitted into said slots for receiving the radially-movable jaw elements in said one set.

5. The power tong of claim 4 wherein said slots extend radially outwardly from the inner peripheries of said plate members and are located adjacent said cam surfaces on the inner periphery of said annular rotor.

6. In a power tong, the combination of:

a housing;

a generally annular rotor carried by said housing and rotatable relative to said housing about an axis extending generally perpendicular to the opposite sides of said housing;

cam surfaces formed on diametrically-opposite sides of the inner periphery of said annular rotor;

drive means carried by said housing for rotating said rotor;

a jaw assembly comprising plate members on opposite sides of said housing and said annular rotor;

slots in the facing surfaces of said plate members;

jaw elements received within said slots and having members movable radially inwardly along straight-line paths of travel upon relative movement of the plate members and said annular rotor due to movement of said cam followers on associated ones of said cam surfaces; and bolt members interconnecting said plate members and holding said jaw elements in place.

* * * * *